US007575060B2

(12) United States Patent
Hillis et al.

(10) Patent No.: US 7,575,060 B2
(45) Date of Patent: Aug. 18, 2009

(54) COLLAPSE RESISTANCE OF TUBING

(75) Inventors: David John Hillis, Balmedie (GB); Paul David Metcalfe, Peterculter (GB); Simon John Harrall, Inverurie (GB)

(73) Assignee: Weatherford/Lamb, Inc., Houston, TX (US)

( * ) Notice: Subject to any disclaimer, the term of this patent is extended or adjusted under 35 U.S.C. 154(b) by 674 days.

(21) Appl. No.: 10/618,419

(22) Filed: Jul. 11, 2003

(65) Prior Publication Data

US 2004/0055756 A1 Mar. 25, 2004

(30) Foreign Application Priority Data

Jul. 11, 2002 (GB) ..... 0216074.5

(51) Int. Cl.
*E21B 17/00* (2006.01)

(52) U.S. Cl. ..... 166/384; 166/207; 166/297; 166/380

(58) Field of Classification Search ..... 72/53, 72/75, 370.06, 370.08, 370.14, 370.2, 370.22, 72/370.23, 370.24, 370, 370.01; 166/207, 166/380, 382, 384, 297
See application file for complete search history.

(56) References Cited

U.S. PATENT DOCUMENTS

| | | | | | |
|---|---|---|---|---|---|
| 447,582 | A | * | 3/1891 | Robertson | 72/75 |
| 1,596,751 | A | * | 8/1926 | Millspaugh | 72/78 |
| 2,375,108 | A | * | 5/1945 | Hopkins | 72/126 |
| 2,383,214 | A | * | 8/1945 | Prout | 72/45 |
| 2,546,756 | A | * | 3/1951 | Knowlton | 72/126 |
| 2,575,938 | A | * | 11/1951 | Brenneke | 72/75 |
| 2,898,971 | A | * | 8/1959 | Hempel | 29/243.518 |
| 3,643,485 | A | * | 2/1972 | Marcovitch | 72/96 |
| 3,841,137 | A | | 10/1974 | Mehdizadeh | |
| 4,262,518 | A | * | 4/1981 | Creger et al. | 72/393 |
| 4,386,458 | A | | 6/1983 | Evans | |
| 4,825,674 | A | | 5/1989 | Tanaka et al. | |
| 4,909,860 | A | | 3/1990 | England et al. | |
| 5,275,240 | A | * | 1/1994 | Peterson et al. | 166/242.2 |
| 5,665,933 | A | | 9/1997 | Persson | |
| 6,238,489 | B1 | | 5/2001 | Lundell | |
| 6,325,148 | B1 | | 12/2001 | Trahan et al. | |

(Continued)

FOREIGN PATENT DOCUMENTS

GB 2 399 199 9/2004

(Continued)

OTHER PUBLICATIONS

Rick Von Flatm, Oilfield Service Trio Target Jules Verne Territory, Industry News, Friday, Aug. 17, 2001.

(Continued)

*Primary Examiner*—Jack Keith
*Assistant Examiner*—Scott A Hughes
(74) *Attorney, Agent, or Firm*—Patterson & Sheridan, L.L.P.

(57) ABSTRACT

A method of increasing the collapse resistance of a tubular comprises locating a tool having at least one, and typically three, bearing members within a tubular. The bearing members are positioned in engagement with a wall of the tubular to apply a radial force to a discrete zone of the wall. This radial force is then applied to further discrete zones of the wall, the level of radial force being selected such that the collapse resistance of the tubular is increased.

36 Claims, 1 Drawing Sheet

U.S. PATENT DOCUMENTS

| | | | | |
|---|---|---|---|---|
| 6,409,226 | B1 * | 6/2002 | Slack et al. | 285/226 |
| 6,446,323 | B1 * | 9/2002 | Metcalfe et al. | 29/523 |
| 6,457,532 | B1 | 10/2002 | Simpson | 166/380 |
| 6,527,049 | B2 * | 3/2003 | Metcalfe et al. | 166/277 |
| 6,550,539 | B2 * | 4/2003 | Maguire et al. | 166/380 |
| 6,571,870 | B2 * | 6/2003 | Zheng et al. | 166/178 |
| 6,629,567 | B2 * | 10/2003 | Lauritzen et al. | 166/380 |
| 6,662,876 | B2 * | 12/2003 | Lauritzen | 166/380 |
| 2001/0045284 | A1 | 11/2001 | Simpson | 166/313 |
| 2003/0141079 | A1 * | 7/2003 | Doane et al. | 166/387 |

FOREIGN PATENT DOCUMENTS

| | | |
|---|---|---|
| GB | 2 401 638 | 11/2004 |
| GB | 2 407 603 | 5/2005 |
| WO | WO 86/07096 | 12/1986 |
| WO | WO 93/25799 | 12/1993 |
| WO | WO 98/00626 | 1/1998 |
| WO | WO 00/37766 | 6/2000 |

OTHER PUBLICATIONS

A. M. Al-Sharif, Ph.D, and R. Preston, E. Eng., Improvement in UOE Pipe Collapse Resistance by Thermal Aging, Offshore Technology Conference, May 1996, pp. 579-587.

The Proceedings of the Third (1993) International Offshore And Polar Engineering Conference, International Society of Offshore and Polar Engineers, vol. IV, 1993.

PCT Search Report, International Application No. PCT/GB 03/02998, dated Jan. 29, 2004.

Robert Mack and Andrei Filippov, The Effects of Cold Work and Strain Aging on the Hardness of Selected Grades of OCTG and on the SSC Resistance of API P-110—Results of Laboratory Experiments, Paper No. 02066, Corrosion, 2002 NACE International.

Pierre Sutter, Cedric P. Linne, Jean Leyer, Bertine J. Orlans-Joliet, and Emmanuel Varnne, Development of Grades For Seamless Expandable Tubes, Paper No. 01021, Corrosion 2001, 2001 NACE International.

S J. Harrall, A M. Duggan, G L. Innes, The Application of Rotary Expansion to Solid Expandable Tubulars, SPE 74548, 2002, Society of Petroleum Engineers Inc.

GB Search Report, Application No. GB0405424.3, dated Feb. 16, 2006.

* cited by examiner

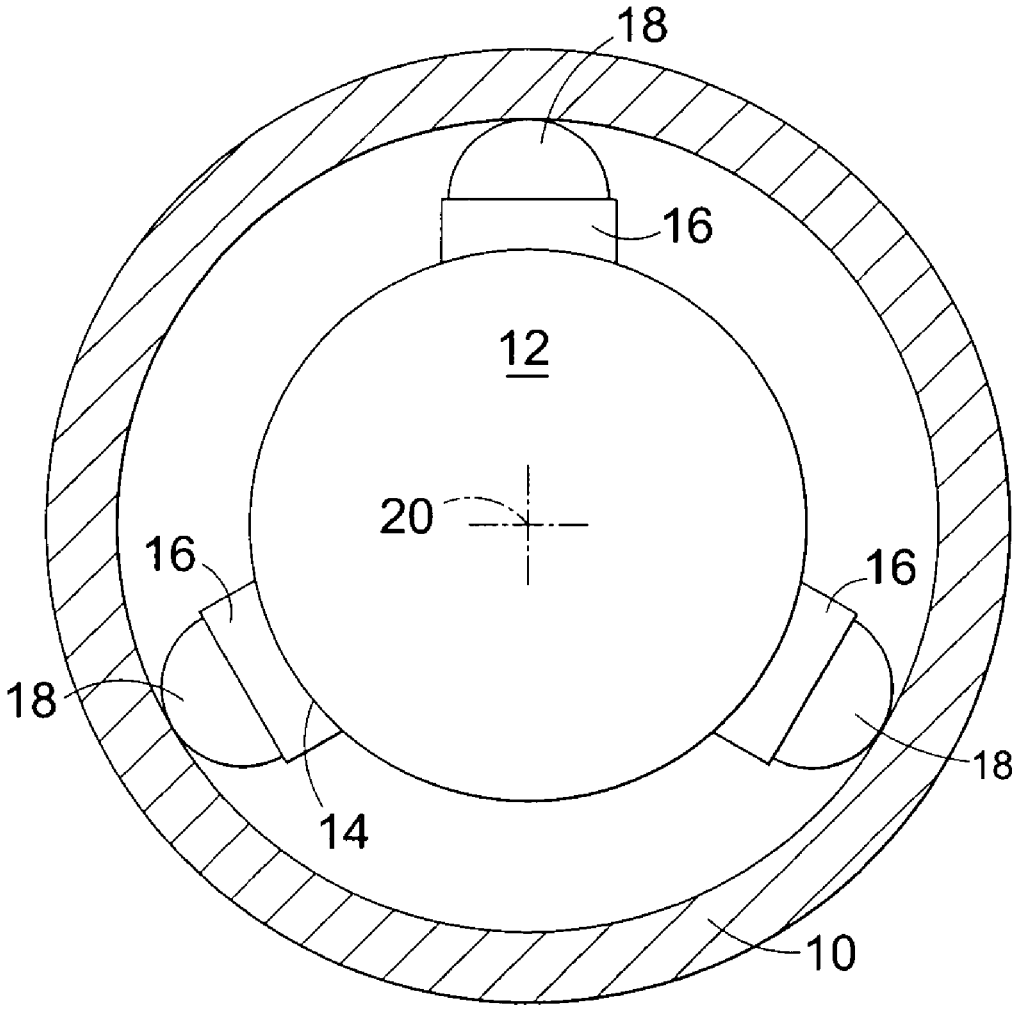
18
16
12
20
16
16
18
18
14
10

COLLAPSE RESISTANCE OF TUBING

FIELD OF THE INVENTION

This invention relates to improving the collapse resistance of tubing, particularly tubing to be utilised in downhole applications.

BACKGROUND OF THE INVENTION

Bores drilled to access subsurface hydrocarbon reservoirs are lined with metal tubing to inter alia prevent-collapse of the bore walls and to provide pressure integrity. The characteristics of the bore-lining tubing utilised to line a bore will be based on a number of factors, one being the collapse or crush-resistance of the tubing. This is the ability of the tubing to withstand external radial forces, as may result from fluid pressure or from mechanical forces applied by a surrounding rock formation. The collapse resistance of a section of tubing may be estimated by means of calculations, typically following an American Petroleum Institute (API) standard formulation (API Bulletin 5C3). Alternatively, a section of tubing with its ends blanked off may be immersed in hydraulic fluid which is then pressurised until the tubing collapses.

SUMMARY OF THE INVENTION

It has been found that the collapse resistance of metallic tubing may be enhanced, in a preferred embodiment, by applying radial forces to discrete areas or zones of the tubing, most conveniently by passing a rotating tool through the tubing, which tool includes at least one bearing member for applying a radially directed force to the tubing wall.

In other embodiments of the invention, other means of increasing the strength or hardness of the tubing are utilised, as will be described.

Preferably, at least an inner portion of the tubular wall is subject to compressive yield or other cold working, which effect may also be achieved through other means, for example by hydraulically expanding the tubular within a higher yield strength outer tubular, or within a bore in a substantially unexpandable body of material.

Conveniently, the tool may be a rotary expansion tool, examples of which are described, for example, in applicant's International Patent Application Publication No. WO 00\37766, and in the SPE Paper 74548 entitled "The Application of Rotary Expansion to Solid Expandable Tubulars", by Harrall et al. As described in the SPE paper, when such a tool is utilised to expand tubing, the tubular material is subjected to strain hardening processes, whereby the yield and tensile strength increase as a function of expansion ratio and the expandable material characteristics. However, the collapse resistance of the expanded tubular is of course less than the original unexpanded tubing, due to the decrease in tubular wall thickness and the increase in diameter.

Surprisingly, it has been found that by passing such an energised rotary expansion tool through a tubular and subjecting the tubular to minimal deformation, which may be apparent as an increase in the length of the tubular, a slight increase in external diameter, or creation of undulations or a wave form on the tubular inner surface, the collapse resistance of the tubing may be increased. The procedure may be carried out on surface, before a tubular is run into a bore, or may be carried out downhole, in existing casing or liner. Of course the radial forces utilised to increase the collapse resistance of the tubing may be achieved using other tool forms and configurations.

It is believed that the invention will have particular utility in increasing the collapse resistance of tubulars which have previously been subjected to swage-expansion. As identified in the above-noted SPE paper, one of the primary concerns with swage-expanded tubulars is the detrimental effect of expansion on collapse performance. It has been suggested that the radial orientation of strain hardening in cone-expanded tubulars, and a subsequent reduction in yield on reversed, collapse loading (Bauschinger effect), is the most likely explanation. Indeed, testing of swage-expanded tubulars indicates that the collapse resistance of such tubulars may be significantly lower than the API 5C3 predictions for given D/t ratios. Thus the invention may be utilised immediately following the swage-expansion of a tubular, or may be carried out as a remedial operation, for example where an operator is concerned that the integrity of a well may be compromised by the presence of swage-expanded tubulars which may provide poorer collapse performance than was originally predicted. Similarly, the present invention may be utilised in instances in which well conditions have or are expected to change to an extent that the collapse resistance of existing casing or liner is deemed inadequate, or where a problem formation is to be isolated and is expected to exert elevated forces or pressures on the tubing: by means of the relatively simple method of the present invention, the collapse resistance of the tubing may be increased in situ. An entire tubing string may be treated, or only a selected part of the tubing may be treated, for example only the part of a casing intersecting a swelling formation may be treated.

Even in applications in which an existing tubular has been cemented in a bore the invention may be utilised to increase the collapse resistance of the tubular.

Although not wishing to be bound by theory, it is believed that the collapse resistance of a tubular can be enhanced by increasing one or both of the strength and hardness of the inner fibre, that is the inside diameter (ID) or inner portion of the bore wall. Whilst this has been demonstrated by increasing the ID surface strength by strain hardening or cold work, the invention encompasses other means of localised surface hardening using metallurgical transformation or diffusion of elements which promote increased hardness by solid solution, precipitation or transformation strengthening mechanisms.

Examples of methods within the scope of the invention include, but are not limited to, cold work by peening or rolling, induction hardening, nitriding and carburising. In other words, any suitable technique for inducing a compressive stress in the inner surface of a tubular, in an effort to increase the collapse resistance of the tubular, may be utilized.

The invention also relates to tubulars which have been subject to the method of the invention.

BRIEF DESCRIPTION OF THE DRAWINGS

These and other aspects of the present invention will now be described, by way of example, with reference to the accompanying, drawing, which is a schematic illustration of a tubular having its collapse resistance increased, in accordance with an embodiment of an aspect of the present invention.

DETAILED DESCRIPTION OF THE DRAWING

The drawing shows a metallic tubular 10, such as utilised in conventional downhole applications. Located within the tubular is a tool 12 similar to the rotary expansion tools as described in WO 00\37766. The tool 12 features a hollow body 14 in which are mounted three equi-spaced pistons 16, each piston carrying a roller 18 which is rotatable about an axis substantially parallel to the body main longitudinal axis 20.

The tool 12 is mounted on a pipe string through which pressurised hydraulic fluid is supplied to the tool body 14. This urges the piston-mounted rollers 18 radially outwardly into contact with the inner wall of the tubular 10. The tool 12 is rotated about its axis 20 and advanced axially through the tubular 10.

The rollers 18 impart a radial force upon discrete zones of the tubular's circumference, cold working the zones, and the rotation of the tools 12 about its longitudinal axis 20 applying this radial force with the resulting cold working to the entire inner circumference of the tubular 10, or at least to a helical path or paths which encompass a substantial proportion of the tubular wall.

The degree of force imparted by the rollers 18, which may be varied during the operation, may be controlled by applying a selected fluid pressure, and may be selected to provide a small degree of diametric expansion to the tubular 10. Alternatively, there may be no appreciable diametric expansion experienced by the tubular 10, the deformation of at least the inner surface of the tubular being accommodated by creation of undulations in the inner wall surface or by an increase in the length of the tubular. Indeed, in many downhole applications there will be no opportunity for diametric expansion, for example if the tubular has been cemented in the bore.

In some cases, in an effort to accurately control the degree (amount) of radial force imparted to the inner surface of the tubular 10 by the rollers 18, one or more sensors may be utilized in conjunction with the tool 12. For example, one or more sensors may be utilized to directly measure the amount of radial force imparted by the rollers 18 (e.g., one or more strain gauges operatively coupled with the rollers 18 or pistons 16), to measure the fluid pressure applied to the inner body 14 of the tool 12 (which may be proportional to the radial force imparted by the rollers 18), or to measure an increase in diameter of the tubular 10. The radial force imparted on the tubular may be controlled by modulating the fluid pressure applied at the surface, in response to any combination of these measured parameters.

Any suitable arrangement of any suitable type sensors may be utilized to measure such parameters. For example, fiber optic sensors, such as fiber optic sensors which utilize strain-sensitive Bragg gratings formed in a core of one or more optical fibers may be utilized. The use of such fiber optic sensors is described in detail in commonly-owned U.S. Pat. No. 5,892,860, entitled "Multi-Parameter Fiber Optic Sensor For Use In Harsh Environments", issued Apr. 6, 1999 and incorporated herein by reference.

The Bragg gratings may be subjected to strain due to one or more measured parameter (e.g., the radial force, fluid pressure or change in outer diameter of the tubular 10). For example, in applications where the outer diameter of the tubing 10 is increased, a change in the outer diameter may be measured with an interferometer formed by two Bragg gratings separated by a length of fiber L wrapped around an exterior of the tubular 10. Changes in the outer diameter of the tubing 10 may be detected by monitoring changes in the length L, detected by interrogating the interferometer. For example, the length L may be determined by the number of wraps of the fiber N around the tubular 10, having an outer diameter OD (e.g., L=N×PI×OD).

Further, utilizing well known multiplexing techniques, such as time division multiplexing (TDM) or wavelength division multiplexing (WDM), different arrays of fiber optic sensors deployed on a common fiber may be distributed along one or more tubulars 10, for example, to monitor the radial stress induced at one or more discrete zones strengthened by radial stress.

EXAMPLE

In order to demonstrate the benefit in collapse resistance obtained using the rotary expansion method as described above, collapse tests on the same material expanded to the same ratio by cone swage-expansion and rotary expansion were conducted.

Material

The expanded material was a proprietary cold-finished & normalised aluminium-killed steel designated VM42. The dimensions were 5 ½" 17# OCTG, i.e. 139.7 mm OD×7.72 mm WT. The rotary expanded material was identified as "heat 345640". In the absence of identifiable heat numbers on the cone-expanded specimen, chemical analysis, metallographic examination and mechanical testing were performed to demonstrate that equivalent materials were tested. In addition to this, a low yield-strength quenched & tempered (Q&T) material of the same dimensions was expanded and collapse tested.

Analysis by Optical Emission Spectrometry.

| | C | Si | Mn | S | P | Ni | Cr | Mo | Nb | Cu | Al | Ti |
|---|---|---|---|---|---|---|---|---|---|---|---|---|
| Nominal VM42 | 0.15 | 0.21 | 0.94 | — | — | 0.04 | 0.10 | 0.01 | — | 0.07 | — | — |
| Cone Expanded VM42 | 0.15 | 0.20 | 0.93 | 0.004 | 0.014 | 0.03 | 0.11 | — | — | 0.02 | 0.034 | — |
| Rotary Expanded VM42 | 0.14 | 0.24 | 0.98 | 0.002 | 0.013 | — | — | — | — | — | 0.029 | — |
| Rotary Expanded Q&T | 0.11 | 0.36 | 1.27 | 0.002 | 0.017 | 0.36 | 0.11 | 0.01 | 0.022 | 0.23 | 0.049 | 0.02 |

The pre-expansion longitudinal and transverse tensile properties are shown below. Longitudinal testing was conducted in accordance with BS EN 10002 Pt 1:2001.

| | VM42 | Q&T Material |
|---|---|---|
| Ultimate Tensile Stress | | |
| MPa | 469-481 | 538 |
| Ksi | 68.0-69.8 | 78.0 |

-continued

| | VM42 | Q&T Material |
|---|---|---|
| 0.2% Offset Proof Stress | | |
| MPa | 344-357 | 442 |
| Ksi | 49.9-51.8 | 64.1 |
| Elongation % | 37-41 | 29 |
| Cross Sectional Area $mm^2$ | — | 94.07 |
| Gauge Length mm | 50.8 | 50 |

Metallographic specimens were prepared from the expanded cone and rotary expanded VM42 material and also the Q&T steel. The VM42 material possessed a banded ferrite-pearlite microstructure consistent with a normalised low carbon steel. The Q&T material exhibited a microstructure comprising fine, tempered martensite.

Expansion Test

Data on the cone-expansion was not available, however the dimensions were consistent with an approximate 139 mm diameter cone. The OD was 154 mm with an average wall thickness of 7.29 mm, giving an OD expansion ratio of 10.2%.

The rotary expansion was conducted using 4.75" compliant tool with a single plane of 20° rollers. The expansion was conducted at 4'/min and 50 rpm in order to maintain wall thickness by restricting elongation to approximately 2%. The expanded OD was, again, 154 mm with the average wall thickness measured at 6.71 mm. The Q&T material was expanded in the same way and produced an average wall thickness of 6.79 mm.

For the rotary-expanded VM42, the expansion demands comprised an axial force of approximately 20000 lbf, generating a torque of 2750 ftlbs at a tool pressure of around 1400 psi.

Post-expansion Tensile Properties

The post-expansion longitudinal tensile properties were evaluated on all three specimens in accordance with BS EN 10002 Pt 1: 2001. The results are listed below.

| | Cone Expanded VM42 | Rotary Expanded VM42 | Rotary Expanded Q&T |
|---|---|---|---|
| Ultimate Tensile Stress | 505 | 565 | 621 |
| | 73.2 | 82.0 | 90.1 |
| 0.2% Offset Proof Stress | 485 | 521 | 570 |
| | 70.3 | 75.6 | 82.7 |
| Elongation | 22.7 | 18.3 | 14.8 |
| Cross Sectional Area | 90.16 | 81.31 | 85.57 |
| Gauge Length mm | 50 | 50 | 50 |

Collapse Testing

The collapse samples were 1430 mm, or greater, in length, giving a sample length in excess of 9.2 times the OD. The collapse test was conducted in a sealed vessel at a ramp rate of between 6 and 9 psi/second, with the pressure continually recorded during the test. The collapse pressure was determined by the sudden pressure drop, resulting from the instantaneous sample volume change on collapse.

The collapse pressures are tabulated below.

| | Cone Expanded VM42 | Rotary Expanded VM42 | Cone Expand d VM42[1] | Rotary Expanded Q&T |
|---|---|---|---|---|
| Length | 9.29 OD | ~10 OD | >8 OD | 9.29 OD |
| D/t | 21.12 | 22.93 | 21.4 | 22.78 |
| API 5C3 Collaps Pressure Estimate, psi | 4119 | 3405 | 4012 | 3663 |
| Actual Collapse Pressure, psi | 3232 | 3830 | 3147 | 4127 |
| Difference from Estimate | −21.5% | +12.5% | −21.6% | +12.7% |

Discussion

The tests demonstrate that the collapse resistance of compliant rotary expanded tubulars is superior to equivalent tubulars expanded using a cone-swaging method. The collapse pressure obtained for the cone-expanded sample used in these tests was consistent with published results (P. Sutter et al, "Developments of Grades for Seamless Expandable Tubes", Corrosion 2001, Paper no. 021, Houston Tex., NACE International, 2001). Furthermore, whilst the cone-expanded sample exhibited a collapse pressure over twenty percent lower than the API prediction, the two different rotary expanded materials exceeded the API estimate by 12.5%.

The applicant, although not wishing to be bound by theory, attributes the difference in collapse performance between rotary and cone-expanded tubulars to the orientation of dislocation arrays produced by the differing cold working process, that is the strain path is helical in the rotary process as opposed to radial in the cone method. This means that on loading in a collapse mode, the dislocation substructure for helically-expanded material is not aligned in a way to suffer from the Bauschinger effect, which relies on total or partial reversed loading. An alternative/contributory factor in rotary-expanded collapse performance is the localised concentration of compressive cold work in the bore of the tubular.

Additionally, for casing-compliant expansions, the collapse resistance in annular and full-system collapse tests have developed resistance far greater than would be anticipated from consideration of the individual tubular capabilities. It is believed this is due to the casing resisting the geometry changes necessary for collapse of the internal tubular.

Published data on cone-expanded tubulars demonstrates that a strain-ageing process can recover collapse resistance, presumably by restricting the mobility of dislocations generated by cold work rather than from the increase in the yield strength of the material. However, strain-ageing is a diffusion-related process and, as such, is dependent on exposure of the material to an elevated temperature for a period of time. As the necessary duration is kinetically related to the exposure temperature, this process is dependent on well-temperature.

An ageing treatment of 5 hrs at 175° C. is quoted. (R. Mack & A Filippov, "The Effects of Cold Work and Strain Aging on the Hardness of Selected Grades of OCTG and on the SSC Resistance Of API P-110—Results of Laboratory Experiments", Corrosion 2002, Paper no. 066, Denver Colo., NACE International, 2002) as a realistic simulation for expanded P-110 material based on a kinetics study. The suppliers have suggested 30 mins at 250° C. for VM42 material. It is assumed that this study consisted of a series of heat treatments of varying time and temperature to derive activation energies and rate constants as per standard Arrhenius relationships, i.e. by plotting In(k) vs 1/T to find the gradient and intercept for $k=k_o\exp(-E_A/RT)$. The "reaction" in this case is the strain-ageing treatment to produce peak hardness or "full-pinning".

The cone-expanded VM42 material was tested after more than eight months exposure to ambient temperatures and did not show even a partial recovery of collapse strength when compared to published data (P. Sutter et al).

Finally, following strain-ageing, a rotary-expanded carbon or low alloy steel tubular could be expected to increase in collapse strength, from its existing high level, by a small extent due to an increase in yield strength.

It will be apparent to those of skill in the art that the above-described embodiment is merely exemplary of the present invention and that various modifications and improvements may be made thereto, without departing from the present invention. For example, in other embodiments of the invention, the radial forces imparted by the rollers 18 as described above may be achieved by other means, for example by use of a tool which is advanced axially without rotation, and which features a plurality of rollers which are rotatable about an axis perpendicular to the tool longitudinal axis, such as the ACE (Trade Mark) tool supplied by the applicant.

In other embodiments, bearing members other than rollers, such as balls or indeed non-rotating members may be utilised to provide the required axial force, although use of non-rotating members would increase the tool-to-tubular friction and increase the forces necessary to move the tool through the tubular.

The invention claimed is:

1. A method of increasing collapse resistance of a tubular, the method comprising:

(a) identifying a desired collapse resistance of the tubular;

(b) locating a tool having at least one bearing member within the tubular;

(c) placing the bearing member in engagement with a wall of the tubular to apply a radial force to a discrete zone of the wall;

(d) applying said radial force to additional discrete zones of the wall; and (e) selecting a level of the radial force to increase the collapse resistance of the tubular to the desired collapse resistance, wherein the selection of the level is independent of any constraining effects on the tubular and wherein applying said radial force induces compressive yield of an inner portion of the wall due to selecting the level of the radial force sufficient to cause the compressive yield.

2. The method of claim 1, wherein applying said radial force induces plastic deformation of the inner portion of the wall due to selecting the level of the radial force sufficient to cause the plastic deformation.

3. The method of claim 1, wherein the bearing member is a rolling element and the tool is moved relative to the tubular to provide a rolling contact between the rolling element and the tubular wall.

4. The method of claim 1, further comprising moving the tool relative to the tubular to provide a sliding contact between the bearing member and the tubular wall.

5. The method of claim 1, wherein the tool is advanced axially relative to the tubular.

6. The method of claim 1, wherein the tool is rotated relative to the tubular about a longitudinal axis of the tubular.

7. The method of claim 1, wherein the tool is located within the tubular.

8. The method of claim 1, wherein applying the radial force causes a degree of diametric expansion of the tubular.

9. The method of claim 8, wherein applying the radial force causes permanent diametric expansion of the tubular.

10. The method of claim 1, wherein the tubular experiences little or no diametric expansion.

11. The method of claim 1, wherein the tool is moved relative to the tubular such that the bearing member describes a helical path along the tubular wall.

12. The method of claim 1, wherein the tool has a purality of bearing members, and each bearing member is urged into engagement with the wall of the tubular to impart a radial force to a respective discrete zone of the tubular wall.

13. The method of claim 12, wherein the respective discrete zones are circumferentially spaced relative to one another.

14. The method of claim 12, wherein the respective discrete zones are axially spaced relative to one another.

15. The method of claim 1, wherein the bearing member applies the radial force to the tubular wall as a point load.

16. The method of claim 1, wherein the bearing member applies the radial force to the tubular wall as a line load.

17. The method of claim 1, wherein the bearing member is fluid pressure actuated.

18. The method of claim 1, wherein the tool comprises a plurality of bearing members and at least one of the bearing members is independently radially movable.

19. The method of claim 1, wherein the tool comprises a ball-peening tool and is impacted against the inner surface of the wall.

20. The method of claim 1, wherein the tubular has been previously expanded with a cone swage expander.

21. The method of claim 1, further comprising expanding the tubular with a cone swage expander prior to steps (c) and (d).

22. The method of claim 1, wherein the method is executed on the surface of the earth.

23. The method of claim 1, further comprising locating the tubular in a wellbore drilled to access hydrocarbon reservoirs, wherein steps (b) to (d) are executed downhole within the wellbore.

24. The method of claim 1, wherein the tubular is located within a larger diameter tubular.

25. The method of claim 24, wherein the larger diameter tubular is unexpandable.

26. The method of claim 1, wherein the tool creates a strain path in the wall of the tubular having a circumferential element.

27. The method of claim 26, wherein the tool creates a circumferential strain path.

28. The method of claim 1, wherein the tool creates a helical strain path.

29. The method of claim 1, further comprising constraining an outer diameter of the tubular prior to applying the radial force.

30. A method of increasing radial collapse resistance of a tubular, comprising:

locating a tool having at least one bearing member within the tubular;

placing the bearing member in engagement with a wall of the tubular to apply a radial force to a discrete zone of the wall;

applying said radial force to further discrete zones of the wall; and selecting a level of the radial force to increase the radial collapse resistance of the tubular, wherein applying said radial force induces compressive yield of an inner portion of the wall due to selecting the level of the radial force sufficient to cause the compressive yield and wherein an outer diameter of the tubular experiences no diametric expansion as a result of the radial force applied by the bearing member.

31. A method of increasing collapse resistance of a tubular, comprising:

expanding the tubular with a cone expander;

subsequently, locating a tool having at least one bearing member within the tubular;

placing the bearing member in direct engagement with a wall of the tubular to apply a radial force to first and second separated discrete zones of the wall; and selecting a level of the radial force to increase the collapse resistance of the tubular.

32. The method of claim 31, wherein applying said radial force induces compressive yield of an inner portion of the wall due to selecting the level of the radial force sufficient to cause the compressive yield.

33. A method of increasing radial collapse resistance of a tubular, the method comprising:

(a) locating a tool having at least one bearing member within the tubular;

(b) placing the bearing member in engagement with a wall of the tubular to apply a radial force to a portion of the wall;

(c) applying said radial force to another portion of the wall; and (d) selecting a level of the radial force to increase the radial collapse resistance of the tubular independent of any constraining effects on the tubular, wherein applying said radial force induces compressive yield of an inner portion of the wall due to selecting the level of the radial force sufficient to cause the compressive yield and wherein an outer diameter of the tubular experiences no appreciable diametric expansion as a result of the radial force applied by the bearing member.

34. The method of claim 33, wherein applying said radial force induces plastic deformation of the inner portion of the wall due to selecting the level of the radial force sufficient to cause the plastic deformation.

35. The method of claim 33, wherein the tubular has been previously expanded with a cone swage expander.

36. The method of claim 33, further comprising expanding the tubular with a cone swage expander prior to steps (b) and (c).

* * * * *